United States Patent [19]

Cant

[11] Patent Number: 4,640,784

[45] Date of Patent: Feb. 3, 1987

[54] METHOD AND APPARATUS FOR CLEANING SWIMMING POOLS

[75] Inventor: Peter R. Cant, Woollahra, Australia

[73] Assignee: Cant Investments Pty. Limited, New South Wales, Australia

[21] Appl. No.: 760,123

[22] Filed: Jul. 29, 1985

[51] Int. Cl.[4] ..... C02F 1/40

[52] U.S. Cl. ..... 210/776; 210/169; 210/221.2

[58] Field of Search ..... 210/169, 220, 220.1

[56] References Cited

U.S. PATENT DOCUMENTS

| | | | |
|---|---|---|---|
| 1,762,366 | 6/1930 | Test | 210/169 |
| 2,439,866 | 4/1948 | Saladin . | |
| 2,979,206 | 4/1961 | Konopka | 210/169 |
| 3,034,653 | 5/1962 | Ward | 210/169 |
| 3,139,628 | 7/1964 | Richards . | |
| 3,143,499 | 8/1964 | Miller | 210/169 |
| 3,157,597 | 11/1964 | Burba | 210/169 |
| 3,261,371 | 7/1966 | Vernon . | |
| 3,668,713 | 6/1972 | Baker . | |
| 3,712,470 | 1/1973 | Gasloser | 210/169 |
| 3,817,382 | 6/1974 | Arneson | 210/169 |
| 3,841,487 | 10/1974 | Villette . | |
| 3,910,840 | 10/1975 | Adam | 210/169 |
| 3,997,925 | 12/1976 | Hough . | |
| 4,121,307 | 10/1978 | Patterson . | |
| 4,325,462 | 4/1982 | Gouzos | 210/169 |
| 4,519,914 | 5/1985 | Etani | 210/169 |

FOREIGN PATENT DOCUMENTS

| | | |
|---|---|---|
| 0468660 | 12/1975 | Australia . |
| 2329891 | 1/1975 | Fed. Rep. of Germany . |
| 2543464 | 4/1977 | Fed. Rep. of Germany . |
| 0461828 | 2/1937 | United Kingdom . |
| 856084 | 12/1960 | United Kingdom . |
| 1372369 | 10/1974 | United Kingdom . |

*Primary Examiner*—Bernard Nozick

*Attorney, Agent, or Firm*—Wood, Herron & Evans

[57] ABSTRACT

A method and apparatus of cleaning debris from swimming pools includes upper spray jets mounted to one of the pool endwalls for moving a surface layer of pool water approximately 150 millimeters in depth toward the opposite endwall, lower spray jets mounted to each pool sidewall near the bottom for carrying submerged debris to the moving surface layer of pool water, and at least one weir mounted in the opposite endwall which connects to a filter. The weir is adapted to create a positive suction force in the surrounding pool water when the system is operating to draw the pool water and debris it contains from the pool, into the weir and then to the filter for removal of the debris from the water.

31 Claims, 9 Drawing Figures

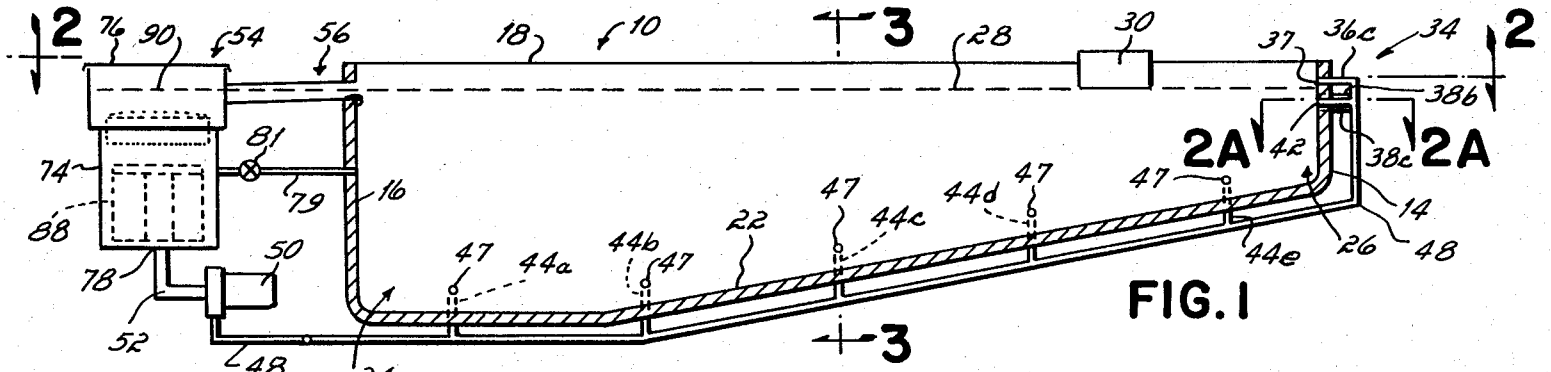
FIG. 1
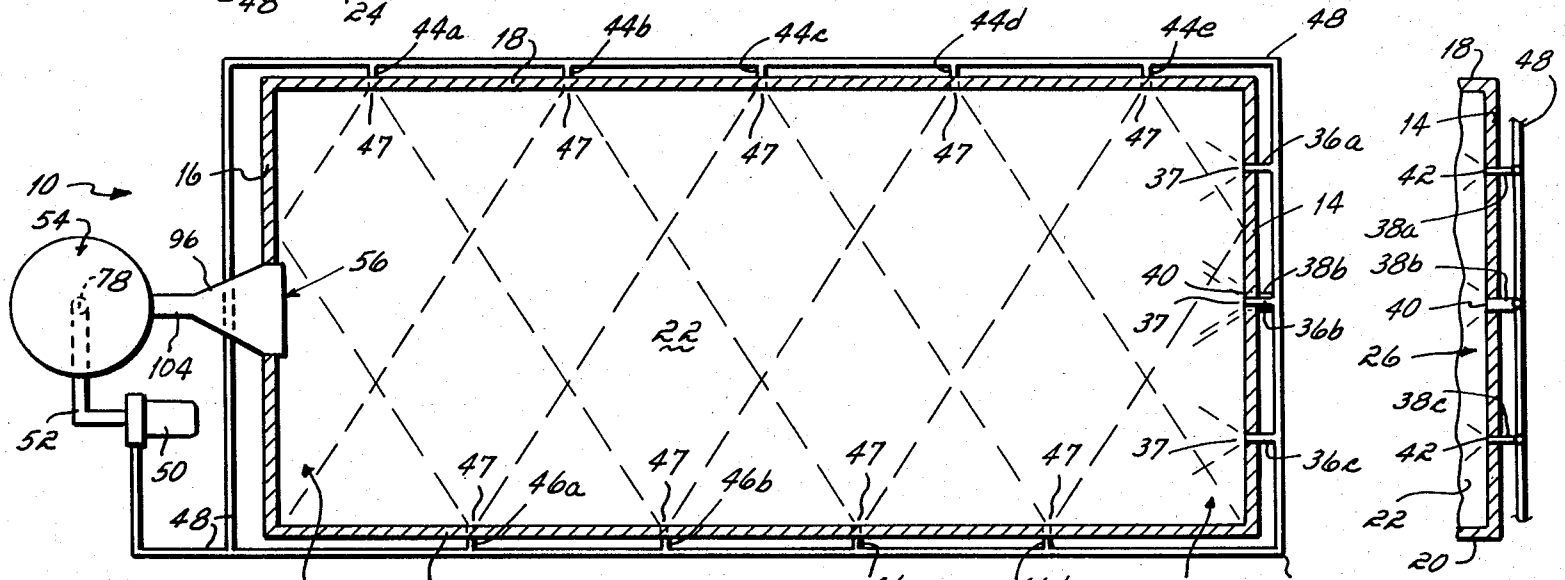
FIG. 2
FIG. 2A

METHOD AND APPARATUS FOR CLEANING SWIMMING POOLS

BACKGROUND OF THE INVENTION

This invention relates to swimming pools, and, more particularly, to a method and apparatus for automatically removing submerged and floating debris from the pool water of a swimming pool.

One of the drawbacks of owning a swimming pool, particularly those located outdoors, has been the time required to maintain the pool free of leaves, grass, bark, dust and other debris as well as algae and bacteria. Pool maintenance can be especially time consuming in areas of heavy pollution or where the pool is located around shade trees or other sources of wind-borne debris.

Studies have indicated that when debris such as leaves, grass or bark falls or is blown into a swimming pool it will float for some period of time before becoming saturated and then sinking to the bottom. The time involved varies according to the type of material falling into the pool and such factors as age, dust load and the like. Pool maintenance is easiest when debris is removed from the surface of the pool before it has a chance to sink to the pool bottom or along the sidewalls.

One currently used method of pool cleaning involves the use of a submerged mobile unit connected to the filter pump suction of the pool which is movable along the pool bottom to suction submerged debris. Another system employs a series of hoses connected to the filtration pump discharge which move about near the bottom of the pool and spray jets of water to sweep sediment towards a bottom outlet of the pool and/or attempt to maintain the sediment in suspension for progressive removal by the normal pool filtration system.

The primary deficiency with each of the systems described above is their inability to quickly remove floating surface debris and/or partially submerged debris, such as leaves, loose grass or pieces of bark, before it sinks to the pool bottom. Such systems operate only after the debris has sunk to the bottom of the pool or become suspended throughout the entire depth of the pool water.

Pool cleaning systems have been proposed to remove floating debris before it has a chance to sink. Such systems generally include a scum gutter located about the perimeter of the pool having an upper edge above the surface of the pool water. Water is sprayed onto the surface of the pool by surface jets or a hand held hose to wash or splash the surface debris over the upper edge and into the scum gutter where it must be manually collected.

Pool cleaning systems employing scum gutters are generally ineffective and of limited use for several reasons. The above-surface water jets, acting alone, are ineffective in moving surface debris in the desired direction even with the slightest air movement in an opposite direction. The result is that floating debris can drift to other parts of the pool and finally become saturated enough to sink to the bottom. Even if some of the surface debris is splashed into the scum gutter, it must be removed therefrom by hand. In addition, such systems generally do not include any subsurface or submerged jets or other means to remove sunken debris from the pool bottom or sidewalls. Sediment is thus allowed to collect on the pool bottom which requires manual cleaning to be removed.

SUMMARY OF THE INVENTION

It is therefore among the objects of this invention to provide a method and apparatus for cleaning swimming pools which removes floating debris such as detritus materials and the like before it becomes saturated and sinks to the bottom, which is completely automatic in operation eliminating virtually all manual cleaning of the pool, which is adapted to remove both submerged and floating debris from the pool, and which provides a positive, suction force to remove pool water carrying debris from the pool for filtering.

These objects are accomplished in a pool cleaning system according to this invention which comprises upper spray jets mounted to one end wall of the pool near the water surface, lower spray jets mounted to each of the sidewalls of the pool near the bottom, a primary filter unit disposed exteriorly of the pool and a weir mounted in the end wall opposite the surface spray jets which communicates with the primary filter. The upper spray jets are adapted to move a surface layer of pool water, approximately 120 to 150 millimeters in depth, toward the weir mounted in the opposite end wall. The submerged, lower jets are adapted to move submerged debris toward the surface of the pool water and into the moving surface layer of water created by the upper spray jets. The weir is constructed so as to create a positive suction force to draw the pool water and debris near the weir from the pool and into the primary filter.

More specifically, in one presently preferred embodiment of this invention the upper and lower spray jets are connected to a common water line which communicates with the primary filter. The suction side of a pump is mounted in the water line downstream from the primary filter so that pool water is drawn through the weir, into the primary filter and then pumped out the upper and lower jets back into the pool. The upper spray jets include a plurality of spaced spray jets mounted slightly above the surface of the pool water, and a like number of spray jets mounted slightly below the surface of the pool water. The above surface spray jets and subsurface spray jets are each adapted to spray a jet of water at a pressure of about 20 psi and have nozzles which discharge the water at a spray angle of approximately 65°. Preferably, the above surface spray jets are mounted so as to direct a stream or spray of water parallel to the pool water surface, while the subsurface spray jets are angled upwardly so that their water streams break the surface of the pool at a distance of about 1 meter from the end wall. The above surface and subsurface spray jets are operable to move an upper layer of pool water, approximately 120 to 150 millimeters in depth measured from the water's surface, toward the weir mounted in the opposite end wall. Floating debris, as well as debris which is suspended immediately below the pool water surface, is thus carried toward the weir for removal from the pool.

In order to remove debris which has sunk to the pool bottom or rests along the pool sidewalls, a plurality of lower spray jets are mounted to each of the pool's sidewalls near the pool bottom. In a presently preferred embodiment, the spray jets mounted along one sidewall of the pool are spaced or staggered from those mounted in the opposite sidewall so that none directly align. The spray angle and spacing of the lower spray jets is such that the water spray from a spray jet on one sidewall intersects the water spray of a spray jet from the opposite sidewall near the center of the pool. This creates upwardly moving currents or eddies where the sprays from opposite sidewalls meet which urge debris suspended in the pool water, and debris from the bottom of the pool, upwardly toward the moving surface layer of pool water created by the upper jets. In this manner, both the submerged and floating debris is carried within the moving upper layer of pool water to the weir for removal.

In one embodiment of this invention, both the upper spray jets and lower spray jets are connected to a single, perimeter water line which communicates with the primary filter unit. In an alternative embodiment, two separate water lines are utilized. A first water line connects the upper spray jets with the primary filter unit and a primary pump operates to draw water through the weir, into the primary filter and then through the first water line to the upper spray jets. A second water line communicating with the pool is connected to the lower spray jets. The second water line includes a secondary filter and a secondary pump for pumping water from the pool, into the secondary filter and then back into the pool through the lower spray jets.

The primary filter unit of this invention comprises a strainer basket which receives a coarse screen, a secondary screen of finer mesh wire mounted beneath the coarse screen and a cartridge filter. The suction side of a pump is mounted in a water line connected to the bottom of the strainer basket so that the pool water is first drawn over the coarse screen, then over the finer screen and finally through the cartridge filter for the removal of progressively smaller particles of debris from the pool water. The operation of the primary filter herein is different from conventional filtering systems for pools wherein the pump is disposed upstream from the filter so as to pump water under positive pressure from the pool into the filter. In this invention, a negative pressure is created in the primary filter when the pump is operational because the pump is located downstream from the primary filter. When the pump is non-operational, the water contained in the primary filter is at atmospheric pressure.

The weir of this invention is adapted to create a positive, suction force in the pool water at the end wall where it is mounted so as to accelerate the surrounding pool water and debris it contains into the primary filter for filtering. The weir includes a weir lip extending outwardly from an opening formed in the endwall of the pool to a point below the pool water surface, and a weir throat connecting the weir lip with the primary filter. The weir lip has a convex upper surface disposed vertically above the end of the weir throat connected to the primary filter. The weir throat thus angles downwardly from the weir lip to the primary filter located exteriorly of the pool.

In one embodiment of the swimming pool apparatus herein, a single weir is mounted near the center of the pool endwall having a weir lip which is approximately one meter in length. In this embodiment, the convex upper surface of the weir lip is positioned approximately 55 millimeters below the surface of the pool water with the primary and/or secondary pumps of the system not operating. When the system is operational, the water level in the pool rises about 5 millimeters while the water level in the filter drops about 50 millimeters.

In an alternative embodiment of this invention, two weirs are mounted in the endwall of the pool, with a space therebetween, and each has a weir lip of approximately one meter in length. In this embodiment, the convex surface of each weir lip is disposed approximately 35 millimeters below the surface of the pool water with the primary and/or secondary pumps non-operational. When the system is operated, the water level changes in both the pool and primary filter unit are substantially the same as in the single weir embodiment mentioned above.

The shape and location of the weir of this invention creates an acceleration of the pool water across the weir lip with the primary and/or secondary pumps operating so as to apply a positive suction force immediately adjacent the weir lip to draw the pool water and the debris it contains through the weir throat and into the primary filter. Acceleration of water over the weir lip is based on the same principle as the upward lift generated by movement of air over an aircraft wing. Due to the convex shape of the upper surface of an aircraft wing, air flow over such surface is accelerated compared to the air flowing along its flat bottom surface. The same is true of the convex surface of the weir of this invention.

Unlike the aircraft wing, the weir lip is fixed to the end wall of the pool and other forces are present to create an acceleration of the pool water over the convex upper surface of the weir lip. Such forces include the force exerted by movement of the water from the pool over the weir lip and into the primary filter due to the increase in the water level of the pool and decrease in the water level within the primary filter, the gravitational force of the water on the weir lip as the water cascades into the downwardly angled weir throat to the primary filter, the stretching of water on the convex upper surface of the weir lip causing a lowered pressure thereat and the cohesion or surface tension of the water tending to prevent stretching of the water at the weir lip.

Dynamic equilibrium of the forces at the weir lip is achieved only by suctioning or pulling water in the area of the weir lip from the pool and into the weir throat thus creating a lift or accelerating effect. The gravitational force exerted on the water, and the surface tension of the water as it flows over the weir lip and into the inclined weir throat, tend to drag or suction the water in the immediate area of the weir lip out of the pool. The pool water cannot move in the opposite direction because the weir throat is inclined downwardly from the pool toward the primary filter unit. A distinct suction force is therefore created immediately below the surface of the water at the weir lip which pulls the pool water, and any debris it contains, over the weir lip, through the weir throat and into the primary filter for filtering.

The method of pool cleaning according to this invention is intended to remove debris from the pool at timed intervals, preferably before it becomes saturated and sinks to the bottom. A surface layer of pool water is moved by the periodic operation of upper spray jets from one end wall toward a weir mounted in the opposite end wall. Floating debris, and debris immediately beneath the pool water surface is carried across the length of the pool within the moving surface layer. Debris which has fallen rapidly to the pool bottom is moved upwardly to the moving surface layer of pool water by a plurality of subsurface spray jets mounted to the pool sidewalls, so that both floating and submerged materials are moved toward the weir for removal from the pool water.

The configuration and positioning of the weir of this invention creates an acceleration of the pool water at the endwall opposite the upper spray jets in a manner analogous to the acceleration of air over the convex upper surface of an aircraft wing. Forces acting at the lip of the weir apply a positive suction force to the pool water immediately beneath the surface of the weir lip which draws the pool water and any debris it contains over the weir lip, through the throat of the weir and into the primary filter.

Debris is thus removed from the pool by a positive suction force with the system of this invention, which is in contrast to prior art pool cleaning systems wherein pool water and floating debris was washed or splashed over an upper edge of a scum gutter for subsequent removal by hand.

DESCRIPTION OF THE DRAWINGS

The structure, operation and advantages of a presently preferred embodiment of this invention will become further apparent upon consideration of the following description taken in conjunction with the accompanying drawings, wherein:

FIG. 1 is a side elevational view of a swimming pool incorporating one embodiment of the cleaning system of this invention;

FIG. 2 is a plan view of the swimming pool system shown in FIG. 1 taken generally along line 2—2 of FIG. 1;

FIG. 2A is a partial cross sectional view taken generally along line 2A—2A of FIG. 1 illustrating the subsurface spray jets of the upper jets herein;

DETAILED DESCRIPTION OF THE INVENTION

Figure 3:
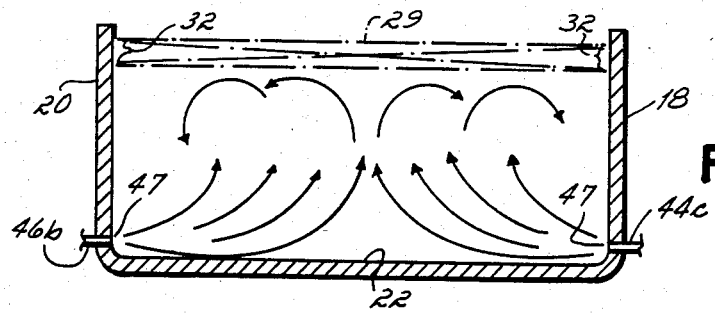
FIG. 3 is a cross-sectional view taken generally along line 3—3 of FIG. 1 showing the water movement in the pool induced by the lower spray jets and upper spray jets.

Referring now to FIGS. 1–3, one presently preferred embodiment of a swimming pool cleaning system 10 according to this invention is illustrated. The cleaning system 10 is adapted to clean debris such as leaves, bark, grass and other materials (not shown) from a pool 12 having opposed end walls 14, 16, opposed sidewalls 18, 20 and a pool bottom 22 which is angled to form a deep end 24 and shallow end 26. The pool is filled with water and its design surface level 28 is maintained substantially constant by a commercially available leveling device 30. For purposes of the present discussion, the level or height of the pool water surface will be expressed in terms of a "design" level and "operating" level. The "design" water level 28 of the pool 12 refers to a predetermined water height when the system 10 of this invention is not operating. The "operating" water level 29 of the pool 12 refers to the height of the water when the system 10 is operating.

One aspect of the pool cleaning system 10 according to this invention is to create movement of a surface layer 32 of pool water from the end wall 14 at the shallow end 26 of the pool 12 toward the end wall 16 at the deep end 24 of the pool 12. Preferably, the depth of the moving surface layer 32 is about 125 millimeters to 160 millimeters measured from the design water level 28 downwardly.

Movement of a surface layer 32 of pool water is achieved by a plurality of upper jets referred to generally with the reference numeral 34 in FIG. 1. The upper spray jets 34 comprise a plurality of spaced, above surface spray jets and a plurality of spaced, subsurface spray jets. In the embodiment shown in FIGS. 1–3, three above surface spray jets 36*a*–*c* are mounted at spaced intervals to the end wall 14 approximately 50 millimeters above the design water level 28 of the pool 12. The above surface spray jets 36*a*–*c* are positioned to direct a spray of water under pressure substantially parallel to the surface of the pool water. Each above surface spray jet 36*a*–*c* includes a discharge nozzle 37 having a spray angle of about 65°.

Three subsurface spray jets 38*a*–*c* are mounted approximately 130 millimeters beneath the design water level 28 of pool 12 in the embodiment of FIGS. 1–3, such that each subsurface spray jet 38*a*–*c* aligns with an above surface spray jet 36*a*–*c*, respectively. The subsurface spray jets 38*a*–*c* are angled upwardly to direct a jet of water which breaks the surface of the pool water approximately one meter from the end wall 14. Preferably, the subsurface spray jet 38*b* nearest the center of end wall 14 has a discharge nozzle 40 which is larger in diameter than the discharge nozzles 42 of the other subsurface spray jets 38*a*–*c*. For example, it has been found that acceptable spray patterns are produced with a discharge nozzle 40 having a diameter of about 12.7 millimeters and discharge nozzles 42 with diameters of about 11.1 millimeters. The larger central discharge nozzle 40 provides a greater flow of water at the center of pool 12, for purposes to become apparent below.

It has been found that three above surface spray jets 36*a*–*c* and three subsurface spray jets 38*a*–*c* are capable of moving a surface layer 32 of pool water approximately 120–150 millimeters in depth toward endwall 16 in pools having a capacity of about 15,000 gallons or less. In such smaller pools, the spray jets 36*a*–*c* and 38*a*–*c* are preferably sized to spray a jet of water under a pressure of at least about 20 psi at a flow rate of approximately 4,000 gallons per hour. For pools having a capacity of over 15,000 gallons, the spray jets 36 and 38 are sized to accommodate a flow rate of about 8,000 gallons per hour and discharge water at a pressure of at least 20 psi. It is contemplated that the number and spacing of the above surface and subsurface spray jets 36, 38 could be modified to accommodate increased flow rates and to cover the entire width of pools of varying sizes and shapes so that moving surface layer 32 extends from one sidewall 18 to the opposite sidewall 20 as shown in FIG. 3.

Movement of surface layer 32 of pool water created by the upper spray jets 34 has been found to effectively carry debris which either rests atop the water surface or immediately beneath, toward the opposite end wall 16. Such debris is drawn from the water in the pool 12, and filtered, in a manner described in detail below. The operation of above surface spray jets 36 and subsurface spray jets 38 is controlled by a timer (not shown) so that debris falling onto the pool surface 28 is periodically removed before it becomes saturated and falls to the pool bottom 22.

Some of the debris falling into the pool 12 sinks quickly to the pool bottom 22, and must also be removed to clean the entire pool 12 effectively. Removal of such submerged or subsurface debris (not shown) is accomplished by a plurality of lower jets mounted to the sidewalls 18 and 20 of the pool. In the embodiment of pool cleaning system 10 illustrated in the Figs., five lower jets 44*a–e* are mounted to the sidewall 18 and four lower jets 46*a–d* are mounted to the sidewall 20. As shown in FIG. 3, each of the lower jets 44*a–e* and 46*a–d* are mounted near the pool bottom 22, preferably at the top of the arc made between the pool bottom 22 and the sidewalls 18, 20, respectively. Each of the lower jets 44*a–e* and 46*a–d* are angled upwardly toward the surface of the pool water at an angle of approximately 25° with respect to the sidewalls 18, 20, respectively. The discharge nozzles 47 of lower spray jets 44*a–e* and 46*a–d* are identical and preferably have a spraying angle of about 65°. The lower jets 44*a–e* and 46*a–d* are operable to eject a spray of water under a pressure of at least 20 psi over a spray distance of not less than about 1.85 meters from their respective sidewalls 18, 20.

Figure 5:
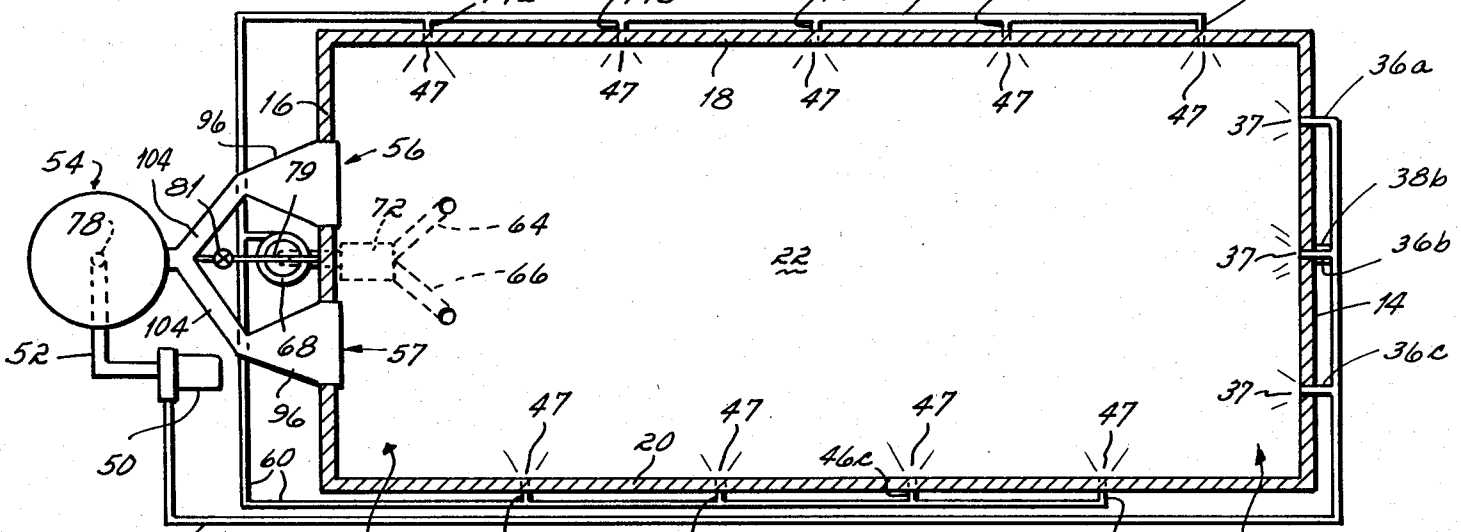
FIG. 5 is a plan view of the alternative embodiment shown in FIG. 4.

As best shown in FIGS. 2 and 5, the lower jets 44*a–e* are staggered with respect to lower jets 46*a–d* such that, for example, lower jet 46*a* mounted to sidewall 20 is disposed along a horizontal axis extending between adjacent lower jets 44*a, b* on the opposite sidewall 18. This staggered or spaced relationship between lower jets 44*a–e* and lower jets 46*a–d* produces a spray pattern shown in FIGS. 2 and 3. The water jet from each of the lower jets 44*a–e*, 46*a–d* moves outwardly at a 65° spraying angle from the sidewalls 18, 20, respectively, such that the water jets intersect near the center of the pool 12 as illustrated in FIG. 2. The collision of the water jets from each sidewall 18, 20, which are directed upwardly from the pool bottom 22 at a 25° angle, forms eddies or currents moving toward the surface of the pool water as shown in FIG. 3.

The water jet sprays from the lower jets 44*a–e*, 46*a–d* first move along the pool bottom 22 to sweep submerged debris from the pool bottom 22 and sidewalls 18, 20, and then the water jet sprays turn upwardly when they collide with one another to carry such debris to the moving surface layer 32. As a result, the submerged debris is moved with the surface layer 32 toward the end wall 16 for removal from the pool 12. While five lower jets 44*a–e* and four lower jets 46*a–d* are illustrated in the Figs., it is contemplated that additional spray jets could be added to accommodate pools of larger size or different shape so long as the spray jets are spaced to create substantially the same spray pattern illustrated in FIGS. 2 and 3.

In the embodiment of the pool cleaning system 10 shown in FIGS. 1–3, the lower jets 44*a–e*, 46*a–d* and the upper jets 34 are supplied with water from the pool 12 through a perimeter water line 48 connected to the discharge side of a primary pump 50. The suction side of the primary pump 50 communicates with the pool 12 through an inlet line 52 connected to a primary filter 54 described in detail below. The primary filter 54, in turn, is connected to the pool 12 by a weir 56.

Figure 4:
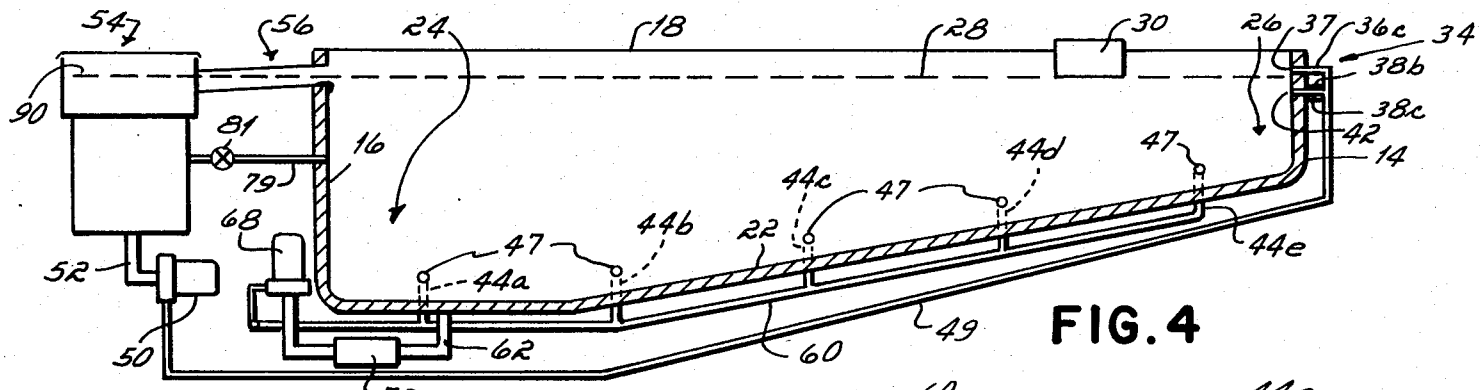
FIG. 4 is a side elevational view of an alternative embodiment of the swimming pool system of this invention.

Referring now to FIGS. 4 and 5, an alternative embodiment of the pool cleaning system 10 according to this invention is illustrated. The system shown in FIGS. 4 and 5 is identical to that of FIGS. 1–3 except for the supply of pool water to the upper spray jets 34 and lower spray jets 44*a–e* and 46*a–d*, and the inclusion of a second weir 57. Therefore, reference numerals used in FIGS. 1–3 are also used in FIGS. 4 and 5 to identify common structure.

In FIGS. 4 and 5, a first water line 49 is connected to the primary pump 50 and upper spray jets 34 for the circulation of pool water from weirs 56, 57, through the primary filter 54 to the upper spray jets 34. A secondary water line 60 supplies pool water to the lower spray jets 44*a–e* and 46*a–d*. The secondary water line 60 communicates with the pool 12 through an inlet line 62 connected to a pair of drains 64, 66 mounted at the bottom 22 of the pool in the deep end 24. The inlet line 62 is connected to the suction side of a secondary pump 68, whose discharge side is connected to the secondary water line 60. A coarse filter 72 is disposed in the secondary water line 60 to filter sand and other heavy particles suctioned from the bottom 22 of the pool 12 through the drains 64, 66.

As shown in FIGS. 4 and 5, a second weir 57 is provided in this embodiment in addition to the single weir 56 used in the embodiment of FIGS. 1–3. It is contemplated that the system of FIGS. 4 and 5 would be utilized for larger pools having a capacity of 15,000 gallons or more to accommodate the additional volume of water and physical size of the pool. In addition, the system of FIGS. 4 and 5 could be utilized in areas of high pollution for pools of any size where added capacity is required to remove high concentrations of debris from the pool. The operation of the systems in FIGS. 1–5 is otherwise identical as described in more detail below.

Referring now to FIGS. 1, 2, 6 and 7, the main or primary filter 54 utilized in both of the embodiments described above is illustrated in more detail. The primary filter 54 comprises a strainer basket 74 disposed exteriorly of the pool 12 adjacent the end wall 16. The open top of the strainer basket 74 is closed by a cover 76, and its bottom surface is formed with a bore 78 adapted to receive the inlet line 52 connected to the suction side of pump 50. A pressure relief line 79, having a valve 81, extends between the strainer basket 74 and into the pool 12 through the endwall 16.

In a presently preferred embodiment of primary filter 54, a conical shaped, coarse screen 80 and a rectangular shaped sieve 82 are supported by a frame 84 on a shoulder 86 formed in the wall of the strainer basket 74. The coarse screen 80 is mounted atop the sieve 82 so that pool water passes through the coarse screen 80 first for the removal of large articles such as leaves, bark and the like. The sieve 82, positioned downstream from the coarse screen 80, is formed of 20 to 200 mesh for removing finer particles which pass through the coarse screen 80. Below the screen 80 and sieve 82 is a cartridge filter 88 which rests atop the bottom of the strainer basket 74. The cartridge filter 88 has the capacity to filter particles as small as 5 microns at a flow rate of 4,000 gallons per hour. The capacity of all of the filters in strainer basket 74 is such that 80–100% of the pool volume can be filtered during an operational period of approximately 1–3 hours.

As described in more detail below, when the primary pump 50 is not operating the water level 90 within the filter 54 is at the same level as the design water 28 in pool 12, and is at least about 50 millimeters below the cover 76 which closes the top of strainer basket 74.

With the primary pump 50 connected by an inlet line 52 to the bottom of filter 54, water is drawn through the filter 54 from the pool 12 rather than being pushed therethrough. A suction is therefore applied to draw water through the filter 54 so that it operates under a negative pressure. When the primary pump 50 is not operating, the water in the primary filter 54 is under atmospheric pressure.

Figure 6:
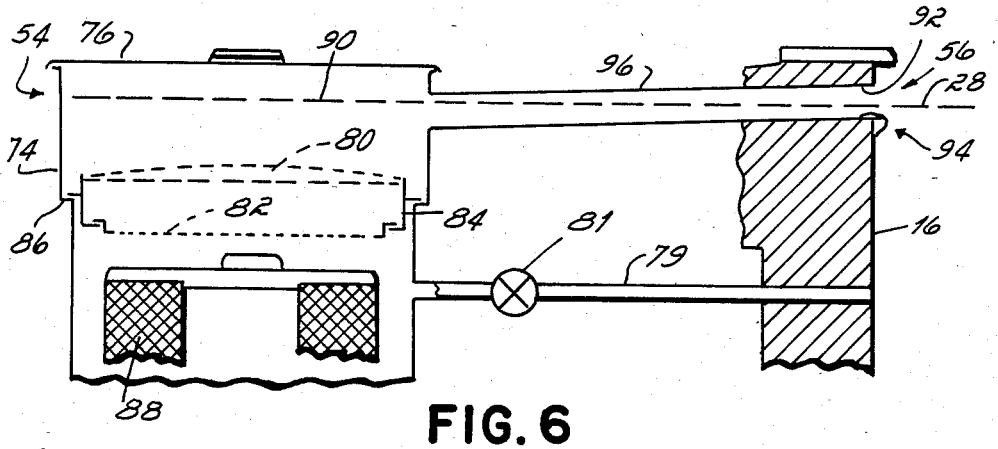
FIG. 6 is a side elevational view in partial cross section of the weir and primary filter unit of this invention with the primary pump not operating.
Figure 7:
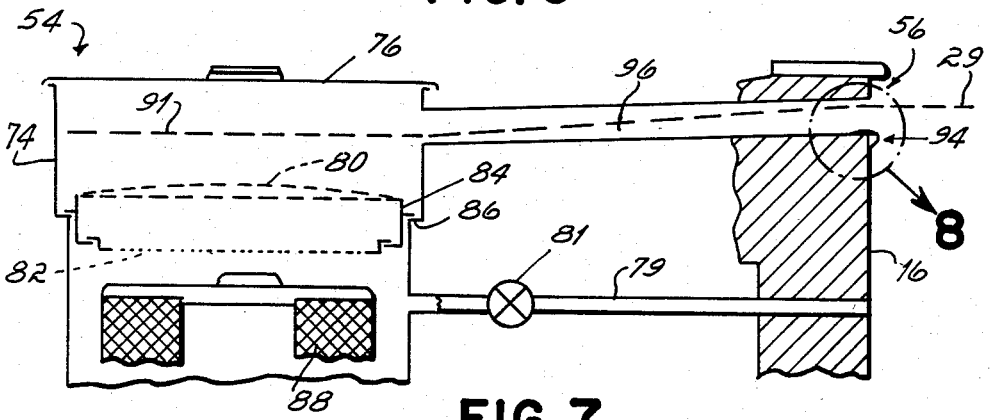
FIG. 7 is a view similar to FIG. 6 with the primary pump operating.
Figure 8:
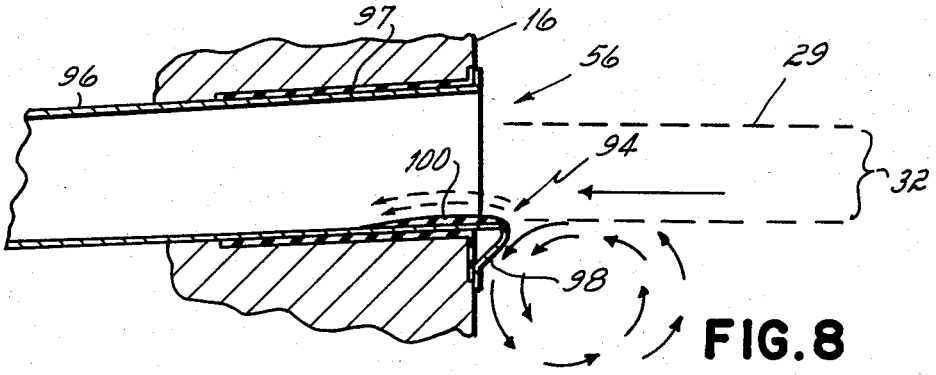
FIG. 8 is an enlarged view of the weir shown in FIGS. 6 and 7 illustrating the suction force generated at the weir of this invention.

Referring now to FIGS. 6–8, the weir 56 according to this invention is shown in more detail. It should be understood that the second weir 57, shown in the embodiment of FIGS. 4 and 5, operates in the identical manner as weir 56.

Weir 56 is mounted in a opening 92 formed near the top of the pool end wall 16. The weir 56 includes a weir lip 94 mounted at the lower, forward edge of opening 92 within the pool 12, and a weir throat 96 extending from the weir lip 94 to the primary filter 54. As best shown in FIG. 8, the weir lip 94 includes a forward portion 98 extending downwardly from the opening 92 against the end wall 16 within the pool 12, and a convex upper surface 100 preferably covered with a butyl mastic material. The weir lip 94 extends transversely along the opening 92 formed in the end wall 16 and is preferably approximately 1 meter in length. See FIG. 2. In the embodiment of this invention shown in FIGS. 1–3 in which a single weir 56 is utilized, the uppermost portion of the convex upper surface 100 of the weir lip 94 is disposed approximately 55 millimeters below the design water level 28 of the pool 12. In the embodiment shown in FIGS. 4 and 5, in which two weirs 56, 57 are utilized, the uppermost portion of the convex upper surface 100 of weir lip 94 is disposed approximately 35 millimeters below the design water level 28 of pool 12.

The weir throat 96 extends from the opening 92 in end wall 16, where it is disposed within a sleeve 97 of butyl mastic material, to the filter 54. As shown in FIGS. 2 and 5, the sidewalls of the weir throat 96 taper inwardly at converging angles to a connector pipe 104, having a diameter of about 100 millimeters, which connects directly to the primary filter 54. The weir throat 96 and connector pipe 104 are preferably angled downwardly at an acute angle of about 5°–10° relative to the horizontal from the endwall 16 to the filter 54.

The operation of the pool cleaning system 10 illustrated in FIGS. 1–3 and 6–8 is as follows. The primary pump 50 is activated to draw pool water from the pool 12 through the weir 56 and into the primary filter 54. The water passes through the filter 54 and is pumped along the perimeter water line 48 to the upper jets 34 and lower jets 44*a–e*, 46*a–d*. As described above, the upper jets 34 function to move a surface layer 32 of pool water from the shallow end 26 toward the weir 56 mounted in the end wall 18 at the deep end 24 of the pool 12. At the same time, the lower jets 44*a–e*, 46*a–d* create an upward movement of water at the pool bottom 22 to carry submerged debris toward the moving surface layer 32 near the surface of the pool water.

The size of the primary pump 50 is chosen to provide a flow rate of 4,000 gallons per minute for smaller pools (15,000 gallons or less), and a flow rate of 8,000 gallons per hour for larger pools (exceeding 15,000 gallons). This relatively high volume flow allows the upper spray jets 34 and lower spray jets 44*a–e*, 46*a–d* to move substantially all of the floating and submerged debris to the weir 56 for removal from the pool 12.

The weir 56 of this invention functions to create a positive suction force to draw the pool water immediately adjacent the weir lip 94, and the debris it contains, into the weir throat 96, through the connector pipe 104 and to the filter 54. This suction force is created by an acceleration of pool water across the weir lip 94 in a manner analogous to the lift achieved in an aircraft wing.

At high flow rates, for example 4,000 gallons per hour and higher, several forces are present at the weir lip 94. One force is created by the increase in the height of the water in the pool 12 compared to the water level in the filter 54. As shown in FIG. 6, with the primary pump 50 not operating the design water level 28 in the pool 12 is the same as the water level 90 in filter 54. With the pump 50 operating, as shown in FIGS. 7 and 8, the height of the water in the pool 12 rises approximately t millimeters above the design water level 28 to its operating level 29. At the same time, the water level within filter 54 is lowered approximately 50 millimeters from the design level 90 to its operating level 91 creating a positive flow of water from the pool 12 into the filter 54. The difference in operating levels 29 and 91 between the pool 12 and primary filter 54, respectively, in combination with the downwardly angled weir throat 96 and connector pipe 104, causes the pool water to cascade into the filter 54 and apply a gravitational force to the weir lip 94. Also present at the weir 56 is a force tending to stretch the water over the convex upper surface 100 of the weir lip 94, for an infinitesimal period of time, creating a lowered pressure thereat. This stretching force is resisted, at least in part, by the cohesion or surface tension of the water.

The result of the forces acting on the weir lip 94 is a combination of reduction in pressure caused by stretching of the water over the convex upper surface 100 of the weir lip 94, and a drag of water flowing along the angled weir throat 96 to the filter 54 due to gravity. Dynamic equilibrium between the stretching of the water across the weir lip 94 and the drag along the weir throat 96 is achieved by suctioning the water which surrounds the weir lip 94 into the weir throat 96 from the pool 12. A lift or acceleration of water at the weir lip 94 thus produces a positive suction immediately below the water surface in the area of weir lip 94 as shown in FIG. 8 which pulls both the pool water and any floating or partially submerged debris it contains over the weir lip 94 and into the weir throat 96 where it flows to the filter 54.

The pool water is filtered in the primary filter 54 and then returned to the pool through upper jets 34 and lower jets 44*a–e*, 46*a–d* to complete the cleaning cycle. It should be understood that the pool cleaning system of this invention shown in FIGS. 4 and 5 operates substantially identically to that described above except for the addition of a secondary pump 68 to provide water to the lower jets 44*a–e*, 46*a–d*, and a second weir 57 which functions in the identical manner as weir 56 described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A method of cleaning debris from the pool water of a swimming pool having a bottom, opposed sidewalls, opposed endwalls and a weir mounted in an opening formed in one of the endwalls and extending into the pool, comprising:

spraying water in pressurized streams into the pool to move a surface layer of the pool water toward the endwall having the weir;

applying a suction force to the pool water at the weir for drawing the pool water and debris contained therein into the weir from the pool;

filtering the debris from the pool water entering the weir.

2. The method of claim 1 further including the step of:

spraying pool water near the pool bottom to move debris thereat to the surface layer of pool water.

3. A method of cleaning debris from the pool water of a swimming pool having a bottom, opposed sidewalls, opposed endwalls and a weir mounted in an opening formed in one of the endwalls and extending into the pool comprising:

spraying pool water in pressurized streams from jets mounted in one endwall above and below the surface of the pool water to move a surface layer of pool water and debris contained therein toward the endwall having the weir;

spraying pool water in pressurized streams from jets mounted in at least one sidewall near the pool bottom for agitating the pool water to move submerged debris to the surface layer of pool water;

applying a suction force at the weir to draw at least a portion of the surface layer of pool water and debris contained therein into the weir from the pool; and filtering the debris from the pool water entering the weir.

4. Apparatus for cleaning debris from the pool water of a swimming pool having a bottom, opposed sidewalls and opposed endwalls comprising:

spray jet means mounted to one of said endwalls for spraying water in pressurized streams into the pool to move a surface layer of pool water and debris contained therein toward the opposite end wall;

weir means mounted in an opening formed in said opposite end wall of the pool and extending into the pool water for creating a suction in the pool water thereat to draw pool water and debris carried in the pool water from the pool into said weir means;

filter means communicating with said weir means for filtering debris from the pool water entering said weir means.

5. The apparatus of claim 1 in which at least three above-surface spray jets and at least three subsurface spray jets are mounted to said endwall.

6. The apparatus of claim 4 in which said filter means includes a strainer basket, a coarse screen removably mounted within said strainer basket for filtering large debris, a fine screen removably mounted within said strainer basket dowstream from said coarse screen for filtering smaller sized debris, and a cartridge filter removably mounted within said strainer basket downstream from said fine screen for removing debris of several microns in size.

7. The apparatus of claim 4 further including a a drain line connected to said filter means and a pump mounted in said drain line downstream from said filter means, said pump being operable to draw pool water from the pool, into said weir means and through said filter means into said drain line.

8. The apparatus of claim 7 in which said drain line is connected to said spray jet means, said pump being adapted to pump the pool water drawn into said drain line back into the pool through said spray jet means.

9. The apparatus of claim 7 in which the pool contains less than about 15,000 gallons of water, said suction pump being operable to pump about 4,000 gallons per hour of pool water through said drain line and out said spray jet means back into the pool.

10. The apparatus of claim 7 in which the pool contains more than about 15,000 gallons of water, said suction pump being operable to pump about 8,000 gallons per hour of pool water through said drain line and out said spray jet means back into the pool.

11. The apparatus of claim 4 in which said surface layer of pool water moving toward the opposite endwall is about 120 to 150 mm in depth measured from the surface of the pool water downwardly.

12. The apparatus of claim 4 further including leveler means for maintaining the pool water at a constant, predetermined level in the pool.

13. The apparatus of claim 4 in which the pool water surface is maintained at a predetermined level, said spray jet means including a plurality of spaced above-surface spray jets mounted to said endwall above the surface of the pool water, and a plurality of spaced subsurface spray jets mounted to said endwall immediately below the surface of the pool.

14. The apparatus of claim 13 in which said above-surface spray jets are positioned parallel to the surface of the pool water.

15. The apparatus of claim 13 in which said subsurface jets are angled upwardly from said endwall toward the surface of the pool water, said subsurface jets being adapted to spray a stream of water which breaks the surface of the pool water at a point about one meter from said endwall.

16. The apparatus of claim 13 in which said above-surface spray jets are each spaced approximately 50 millimeters above the predetermined surface level of the pool water.

17. The apparatus of claim 13 in which said subsurface spray jets are each spaced approximately 130 millimeters below the predetermined surface level of the pool water.

18. The apparatus of claim 13 in which each of said spray jets include a discharge nozzle having a spray angle of about 65°.

19. The apparatus of claim 13 in which said above-surface and subsurface spray jets are adapted to spray a stream of water into the pool at a pressure of at least 20 psi.

20. The apparatus of claim 13 in which each of said subsurface spray jets are formed with a discharge nozzle, at least one of said subsurface spray jets being mounted near the center of said endwall and being formed with a discharge orifice of larger diameter than said discharge orifice of said other subsurface spray jets.

21. The apparatus of claim 20 in which the diameter of said subsurface spray jet near the center of said pool endwall is about 12.7 millimeters, and the diameter of said other subsurface spray jet is about 11.1 millimeters.

22. Apparatus for cleaning debris from the pool water of a swimming pool having a bottom, opposed sidewalls and opposed endwalls comprising:

upper spray jet means mounted to one of said endwalls for spraying water in pressurized streams into the pool to move a surface layer of pool water and debris contained therein to the opposite endwall;

lower spray jet means mounted to each of said sidewalls near the pool bottom for spraying water in pressurized streams into the pool to move submerged debris into said surface layer of pool water;

weir means mounted in an opening formed in said opposite end wall and extending into the pool water for creating a suction thereat to draw pool water and debris carried in the pool water from the pool into said weir means; and filter means communicating with said weir means for filtering debris from the pool water entering said weir means.

23. The apparatus of claim 22 further including a perimeter water line connecting said upper spray jet means and said lower spray jet means with said filter means, and a perimeter pump disposed downstream in said water line from said filter means, said primary pump being adapted to pump pool water from the pool, into said weir means, through said filter means and then back into the pool through said upper spray jet means and said lower spray jet means.

24. The apparatus of claim 22 further including a first water line connecting said filter means with said upper spray jet means;

a primary pump mounted in said first water line for pumping pool water from the pool, through said filter means and then back into the pool through said upper spray jet means;

a secondary filter;

a second water line communicating with the pool and connecting said secondary filter with said lower spray jet means; and a secondary pump mounted in said second water line for pumping pool water from the pool, through said secondary filter and then back into the pool through said lower spray jet means.

25. The apparatus of claim 22 in which said lower spray jet means includes a plurality of first spray jets mounted to one of said sidewalls, and a plurality of second spray jets mounted to the other of said sidewalls, each of said first spray jets being staggered along said one sidewall relative to said second spray jets mounted along said other sidewall.

26. The apparatus of claim 25 in which said first and second spray jets each include a discharge nozzle having a spraying angle of about 65°.

27. Apparatus for cleaning debris from the pool water of a swimming pool having a bottom, opposed sidewalls and opposed endwalls, comprising:

spray jet means mounted to one of said end walls for spraying water in pressurized streams into the pool to move a surface layer of pool water and debris contained therein to the opposite end wall;

at least one weir including a weir throat mounted in an opening formed in said opposite end wall of the pool and a weir lip connected to said weir throat, said weir lip extending into the pool water for creating a suction thereat to draw pool water and debris carried therein from the pool over said wier lip and into said weir throat; and a filter connected to said weir throat.

28. The apparatus of claim 27 in which said weir lip includes a forward portion extending into the pool and a convex upper surface.

29. The apparatus of claim 27 in which said weir throat includes a forward end connected to said weir lip and a rearward end connected to said filter means, said forward end being disposed vertically above said lower end.

30. The apparatus of claim 27 in which said filter communicates with said spray jet means, said apparatus further including at least one pump for circulating pool water from the pool, through said weir, into said filter and then out said spray jet means to the pool, said at least one weir comprising a single weir having a weir lip disposed approximately 55 millimeters below the water level of the pool with said pump non-operational, and approximately 60 millimeters below the surface of the pool water with said pump operational.

31. The apparatus of claim 30 in which said filter means is mounted relative to pool such that the water level within said filter means is the same as the surface of the pool water with said pump non-operational, and the water level within said filter means is about 55 millimeters lower than the surface of the pool water with said pump operational.

* * * * *